United States Patent [19]

Campbell

[11] 4,118,000

[45] Oct. 3, 1978

[54] APPARATUS FOR SUPPORTING A MEMBER FROM A DROP-TILE CEILING

[75] Inventor: David Lester Campbell, Anchorage, Ak.

[73] Assignee: George C. Ballas, Houston, Tex.

[21] Appl. No.: 785,444

[22] Filed: Apr. 7, 1977

[51] Int. Cl.[2] ..... A47B 96/06

[52] U.S. Cl. ..... 248/228; 248/340; 248/225.4

[58] Field of Search ..... 248/228, 339, 340, 341, 248/225.4, 225.3, 226.5, 316 R, 316 C, 316 D, 316 E, 316 F, 342, 343, 344; 24/211 R, 211 L, 260; 85/1 H

[56] References Cited

U.S. PATENT DOCUMENTS

| | | | |
|---|---|---|---|
| 1,594,055 | 7/1926 | Filkins | 24/260 |
| 2,817,133 | 12/1957 | Mills | 24/260 |
| 3,743,228 | 7/1973 | Drab | 248/228 |
| 3,932,918 | 1/1976 | Paskert | 24/260 |

FOREIGN PATENT DOCUMENTS

| | | | |
|---|---|---|---|
| 619,668 | 5/1961 | Canada | 248/228 |
| 196,336 | 1908 | Fed. Rep. of Germany | 248/339 |

*Primary Examiner*—Robert A. Hafer

*Attorney, Agent, or Firm*—Arnold, White & Durkee

[57] ABSTRACT

Apparatus for supporting a member from a drop-tile ceiling is characterized by a decorative escutheon having a recess therein sized to receive a resilient grasping element and to guide the grasping element for movement against the bias of its resiliency from a first, open, to a second, grasping, position. In one embodiment the grasping element has a threaded extension extending therefrom which is engaged by a hook structure such that engagement of the hook with the threaded extension draws the grasping element into the recess to move the grasping element from the open to the grasping position. In another embodiment, the grasping member has a threaded nut thereon which receives a threaded element insertable into the escutheon such that progressive threaded engagement draws the grasping element into the recess to move it from the open to the grasping position.

12 Claims, 8 Drawing Figures

APPARATUS FOR SUPPORTING A MEMBER FROM A DROP-TILE CEILING

BACKGROUND OF THE INVENTION

1. Field of the Invention

This invention relates to apparatus for suspending members from the channel beams of drop-tile ceilings, and in particular, to apparatus wherein a resilient grasping element is drawn against the bias of its own resiliency into a recess to move grasping arms thereon from an open to a closed position.

2. Description of the Prior Art

Drop-tile ceilings under consideration utilize channel beams of inverted T shape suspended from the structural members of the building. The ceiling panels are received upon the unexposed sides of the legs of the T. The top surface of the T is presented for view.

With the advent of such drop-tile ceiling construction, the ability to suspend members, such as flowering plants, artistic mobiles or wall partitions, has decreased. This occurs because such suspended ceilings are fabricated of a material usually insufficient to securely support the weight of a hanging member.

The prior art discloses several devices utilizing hook elements having slotted bases adapted to be received over the legs of the T. Typical of such devices are U.S. Pat. Nos. 3,198,471 (Meyer) and 3,618,176 (Barnes). However, such devices must be slipped onto the T-shaped channel beams before the beams are suspended in place, implying a predetermination of location for a suspended member and a permanency not typically encountered.

Other prior art devices have permitted insertion or placement after the fact of erection of the ceiling. Typical of these devices are U.S. Pat. Nos. 3,327,376 (Freeman et al.) and 3,743,228 (Drab). However, these devices are unartistically utilitarian and do not offer an aesthetically pleasing or decorative mode of suspension from drop-tile ceilings. U.S. Pat. Nos. 347,489 (Kenway) and 2,284,302 (Roberts) are typical of prior art construction supports utilizing threaded elements to draw grippers or jaws together to support wire, piping, or the like.

It is therefore advantageous to provide an easily and expeditiously placeable and removeable apparatus able to securely support relatively heavy objects from the channel beams of drop-tile ceilings. It is also advantageous to provide such an apparatus with an aesthetically pleasing or decorative appearance so as not to detract from the appearance of the member being suspended.

SUMMARY OF THE INVENTION

This invention relates to apparatus for suspending an article, as a potted plant, artistic mobile or a wall partition, from a channel beam or T-bar of a drop-tile ceiling. The invention includes a decorative escutcheon having a recess in the underside thereof. An opening is provided extending through the escutheon communicating with the recess therein.

A resilient grasping element, having first and second arms, each of the arms bent at a joint to define facing opposed flanges, is moveable against the bias of its resiliency into the recess in the escutheon. Closure means are provided to move the grasping element to the grasping element to the grasping position. In one embodiment, the closure means comprises a threaded extension on the grasping element sized to pass through the opening in the escutheon. The arms are moveable from an open to a grasping position. In the open position, the clearance, or span between the the flanges is wider than the width dimension of a channel beam of a drop-tile ceiling.

A support hook, adapted to receive the member or item to be suspended, has a threaded aperture therein. The progressive reception of the threaded extension into the aperture draws the resilient grasping element against the bias of its resiliency into the recess to move the arms and flanges to the closed, grasping, position. In the closed position the clearance between the flanges closes, to contact the joints against the lateral edges of the channel beam.

In a second embodiment, the resilient grasping element has an opening therein registerable with the opening in the escutheon and has a threaded nut comprising the closure means. The nut receives a threaded element through the registerable openings such that progressive threaded engagement of the nut with the threaded element moves the grasping element against the bias of its resiliency to the grasping position.

In both embodiments the reeess in the escutheon has a dimension, in a plane perpendicular to an axis through the opening and in a plane parallel to the exposed surface of the channel beam, at least 3/16ths of an inch greater than the width dimension of the channel beam.

BRIEF DESCRIPTION OF THE DRAWINGS

The invention will be more fully understood from the following detailed description thereof, taken in connection with the accompanying drawings which form a part of this application, and in which.

DESCRIPTION OF THE PREFERRED EMBODIMENT

Figure 1:
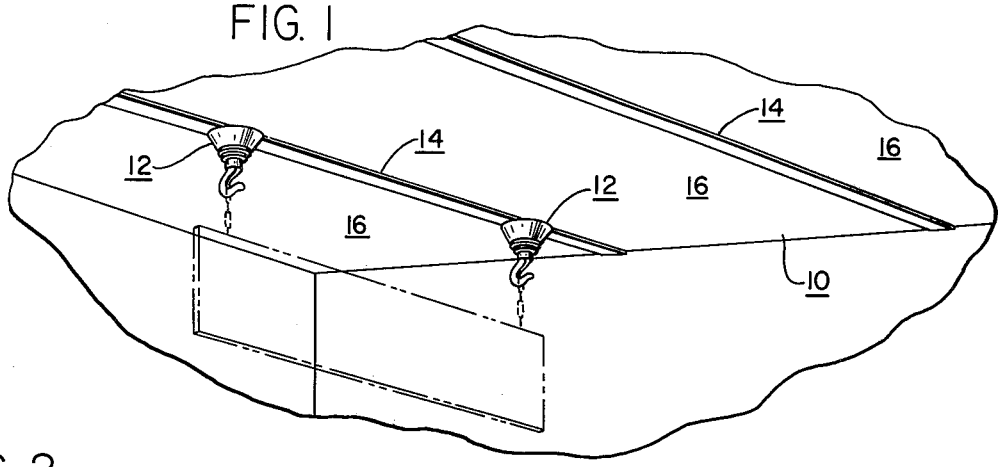
FIG. 1 is a perspective view of a drop-tile ceiling having a supporting apparatus embodying the teachings of this invention suspended therefrom.

Throughout the following description, similar reference numerals refer to similar elements in all Figures of the drawings, which form a part of this application.

In FIG. 1, a perspective view of a drop-tile ceiling 10 having a supporting apparatus 12 embodying the teachings of this invention suspended therefrom. The ceiling 10 is fabricated of a lattice-like framework of structural channel members 14 of an inverted T-construction suspended from the building superstructure by conventional means, as appreciated by those skilled in the art.

A plurality of substantially flat panels 16 are disposed in the area between adjacent legs of the T-bars 14, the peripheral edges of the panels 16 being supported in the under surfaces 15 of the channels 14. The upper surface 17 of the T-bar 14 is exposed to view and defines a substantially planar surface exhibiting a predetermined width dimension, usually 15/16-ths of an inch, between the lateral edges of the T-bar 14.

The supporting apparatus 12 is expeditiously placeable and removable from any desired location along any of the channels 14. The supporting apparatus 12, is fabricated of a construction sufficient to support a relatively heavy load, as a hanging plant with potting arrangement thereof, at least in excess of 50 pounds. Furthermore, the apparatus 12 exhibits a pleasing aesthetic appearance to the eye of an observer.

Figure 2:
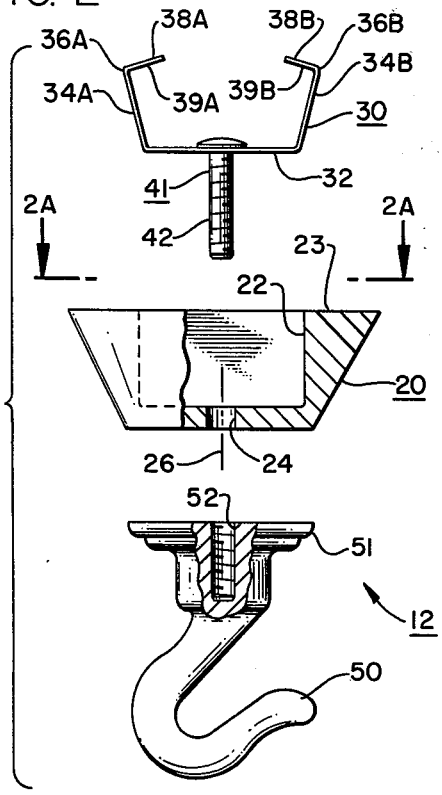
FIG. 2 is an exploded view of the elements comprising a supporting apparatus embodying the teachings of this invention.

In FIG. 2, an exploded view of the supporting apparatus 12 embodying the teachings of this invention. The apparatus 12 includes a decorative escutheon 20, or baseplate having an aesthetically attractive exterior, having a recess 22 on the underside 23 thereof. The escutheon has a central axial opening 24 therethrough, the opening 24 communicating with both the exterior of the escutheon 20 and the recess 22 on the interior, underside 23 thereof. The recess 22 has a predetermined configuration, typically square, when viewed in a plane parallel to the exposed surface 17 of the upper surface of the T-bar or channel 14, or in a plane perpendicular to an axis 26 through the opening 24 in the escutheon. Although a square recess is preferred, it is understood that any predetermined configuration may be used, so long as at least one dimension of the recess 22 is at least three-sixteenths (3/16) of an inch greater than the width dimension of the channel. For example, if the preferred squre recess 22 is utilized in connection with a standard 15/16 inch T-bar 14 of a drop-tile ceiling, the dimension of each side of the mouth of the recess 22 is 1⅛ inches.

A resilient grasping element 30, such as an integral resilient leaf spring, comprises means for grasping a channel 14. Of course, other suitable grasping elements may be utilized. The resilient leaf spring 30 comprises a base portion 32, having first and second substantially upstanding arms 34A and 34B extending therefrom. The end of each of the arms 34 is bent, as at joints 36A and 36B, to define inwardly, opposed flanges 38A and 38B. The resilient grasping element 30 is moveable within the recess 22 from a first, open, to a second, closed or grasping, position.

Figure 3:
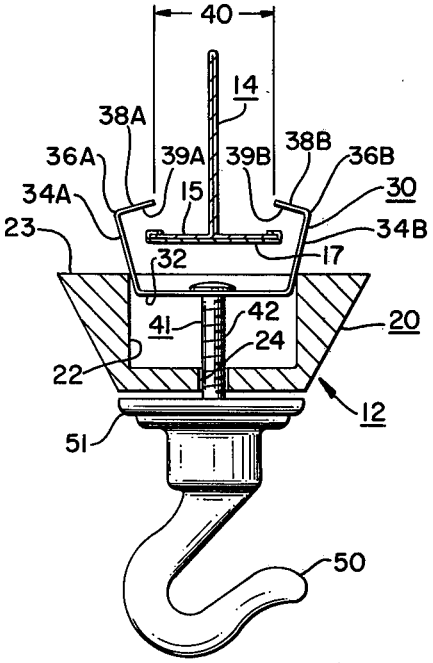
FIG. 3 is a section view taken through a supporting apparatus embodying the teachings of this invention in the first, open, position.
Figure 4:
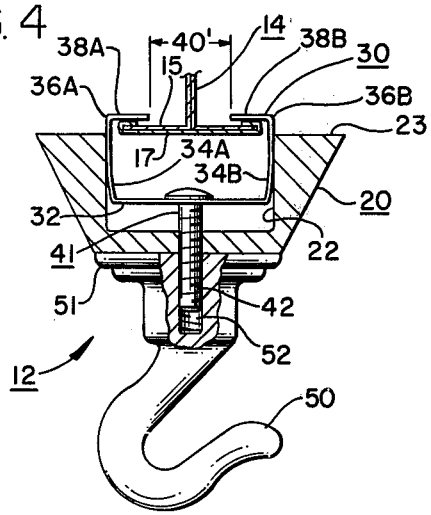
FIG. 4 is a view similar to FIG. 3 showing a supporting apparatus in the second, grasping, position.
Figure 2A:
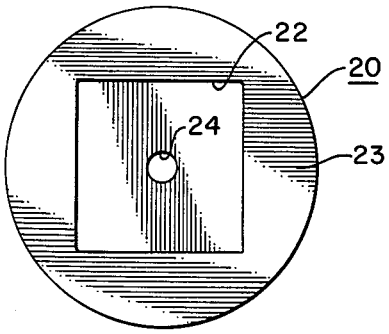
FIG. 2A is a view taken along lines 2A—2A of FIG. 2.

In the first, open, position, the ends of the flanges 38 define a clearance dimension, or span, 40 wider than and sized to fit over the width dimension of the channel 14. (FIG. 3). In the second, grasping, position (FIG. 4), the clearance 40' between ends of the flanges 38 is narrowed, with the inside surfaces of the joints 36 being contacted against the lateral edges of the channel 14. As seen in FIG. 4, to insure support of the member, the inside of the joints 36 are preferably abutted against the lateral edges of the channels 14 with the undersides 39 of the flanges overlapping the unexposed surfaces 15 of the channel 14.

Closure means 41 for moving the grasping means from the first, open, to the second, grasping, position, to close the flanges 38 of the resilient grasping element 30 are provided. In the first embodiment of the invention, the closure means comprises a threaded extension or bolt 42 affixed to and extending from the base 32 of the resilient leaf spring 30. The extension 42 is adapted to pass through the opening 24 through the escutheon 20. A support member 50, such as a hook element with a flared baseplate 51 comprises means adapted to receive a member to be supported from the channel 14. The support member 50 preferably has a threaded aperture 52 therein, the threaded extension 42 being threadedly advanceable or retractable therein. Progressively threaded engagement of the threaded extension 42 within the aperture 52 draws the resilient leaf spring 30 against the resiliency of its bias into the recess 22 in the escutheon 20, to bring the ends of the flanges 38 toward the other, to narrow the clearance span 40. Threading a 3/16 of an inch of the extension 42 ½ inch into the aperture 52 draws the joints 36 into direct abutting contact with the lateral edges of the channel and is sufficient to support at least 50 pounds from the channel 14.

When it is desired to emplace a support apparatus 12 at a predetermined location along a channel 14, it is merely necessary to place the flanges 38, with the initial clearance 40, over the width of the channel 14. Progressive threaded advancement of the extension 42 into the aperture 52 of the support hook 50, as by rotation of the support hook 50, draws the resilient leaf spring 30 against the bias of its resiliency into the recess 24, to close the clearance 40 and bring the joints 36 into the illustrated abutting contact with the edges of the channel 14.

Figure 5:
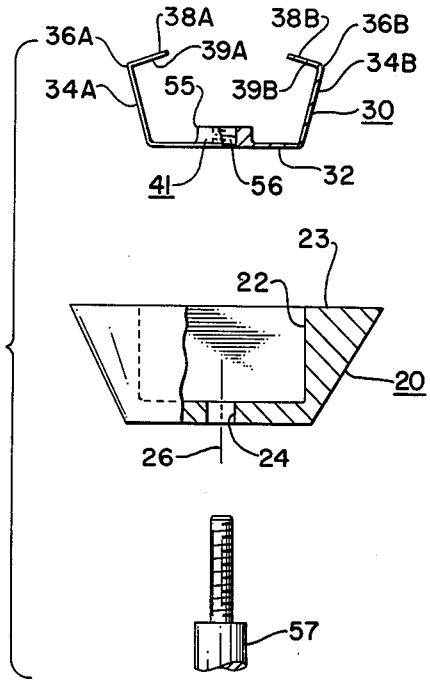
FIG. 5 is an exploded view similar to FIG. 2 of a second embodiment of the invention.
Figure 6:
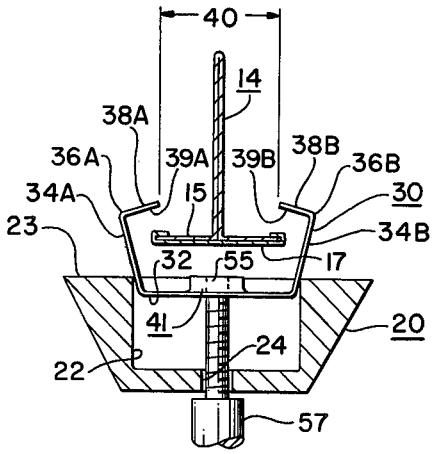
FIG. 6 is a sectional view, similar to FIG. 3, showing the second embodiment of the invention in the open position; and, FIG. 7 is a sectional view, similar to FIG. 4, showing the second embodiment of the invention in the second, grasping, position.

As seen in FIGS. 5 and 6, in a second embodiment of the invention, the closure means 41 comprises a threaded nut 55 disposed about the periphery of an opening 56 in the base 32 of the leaf spring 30. The opening 56 is registered with the opening 24 in the escution 20. The nut 55 is threadedly engageable with an element 57 affixed to a member, as a wall partition, to be supported.

Figure 7:
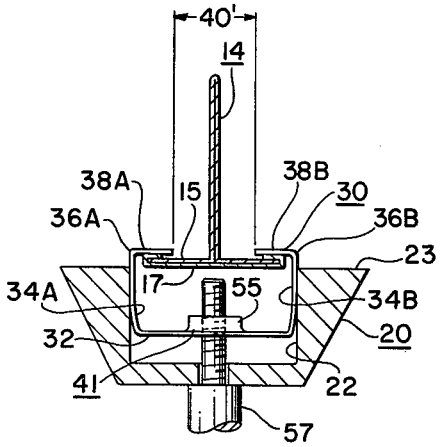

The element 57 is insertable through the registered openings 24 and 56 such that progressive threaded engagement of the nut 55 with the threaded element 57 draws the spring 30 against the bias of its resiliency into the recess 22 to close the clearance 40 and bring the joints 36 into the abutting contact between the lateral edges of the channel, as in FIG. 7.

As is the case with the embodiment of FIGS. 2–4, the recess 22 is square when viewed in a plane parallel to the plane of the exposed surface 17 of the channel 12, or in a plane perpendicular to the axis of the opening 24 in the escutheon 20. It is preferred that the sides of the recess be at least 3/16 of an inch greater than the width of the exposed surface 17 of the T-bar or channel 12.

Having described preferred embodiments of the invention, modifications thereto may be effected as appreciated by those skilled in the art yet remain within the contemplation of this invention, as defined in the appended claims.

What is claimed is:

1. Apparatus for supporting a member from a channel beam of a drop-tile ceiling comprising:

a decorative escutheon having a recess therein and having an opening therethrough communicating with said recess;

a resilient element for grasping the channel beam, said grasping element having a first and a second arm each bent at a joint toward the other to define an inwardly extending flange substantially perpendicular to its associated arm, said grasping element being moveable within said recess from a first, open, position to a second, grasping, position, said grasping element having a dimension between the ends of the flanges such that, in said first position, said grasping element is sized to span the width dimension of the channel beam, said flanges of said grasping element being dimensioned such that, in said second position, the grasping element is in grasping engagement with the channel beam so that said joint in each of said arms is contracted against the edges of the channel beam; and, closure means extending through said opening in said escutheon and connected to said grasping element for moving said grasping element from said first position to said second, grasping, position.

2. Apparatus according to claim 1, wherein:

said grasping element comprises a resilient leaf spring; and, said closure means comprises a threaded extension extending from said leaf spring through said opening in said escutheon.

3. Apparatus according to claim 2, further comprising:

a hook having a threaded aperture therein adapted to receive said threaded extension such that progressive threaded engagement of said extension and said hook draws said resilient spring against the bias of its resiliency into said recess to move said spring from said open position to said grasping position, said hook being adapted to receive a member to be supported therefrom.

4. Apparatus according to claim 1, wherein:

said grasping element comprises a resilient leaf spring having an opening therein registrable with said opening in said escutheon; and, said closure means comprises a threaded nut mounted on said leaf spring to register with said opening therein;

said nut adapted to receive a threaded element insertable through said registered openings in said escutheon and said spring such that progressive threaded engagement of said nut with the insertable element draws said resilient spring against the bais of its resiliency into said recess to move said spring from said open to said grasping position.

5. Apparatus according to claim 1, wherein at least one dimension of said recess in said escutheon in a plane parallel to an exposed surface of the channel beam is at least 3/16 of an inch greater than the width dimension of the channel beam measured in the same plane.

6. Apparatus according to claim 1 wherein said recess in said escutheon is substantially square in a plane parallel to an exposed surface of the channel beam and wherein the dimension of one side of said square is at least 3/16 of an inch greater than the width dimension of the channel beam measured in the same plane.

7. Apparatus for supporting a member from a channel beam of a drop-tile ceiling, comprising:

a decorative escutcheon having a recess in the underside thereof and an opening therethrough communicating with said recess;

a resilient grasping element having first and second arms, the end of each of said arms bending at a joint toward the other to define opposed flanges, said resilient grasping element having a threaded extension sized to pass through said opening in said decorative escutheon, said arms being moveable from a first, open, position to a second, grasping, position as said resilient member is drawn into said recess;

said grasping element in said first, open, position defining a clearance between said flanges wider than the width dimension of a channel beam of a drop-tile ceiling, said grasping element in said second, grasping, position contacting said joints against the lateral edges of a channel beam of a drop-tile ceiling; and, a hook support member for receiving a member to be supported, said support member having a threaded aperture therein, said threaded extension being progressively threadedly engageable within said aperture to draw said resilient member against the bias of its resiliency into said recess to move said resilient member from said first, open, to said second, grasping, position.

8. Apparatus according to claim 7, wherein said recess in said decorative escutheon is substantially square in a plane perpendicular to an axis through said opening.

9. Apparatus according to claim 8, wherein said dimension of said square is at least 3/16 of an inch greater than the width dimension of a channel beam of a drop-tile ceiling.

10. Apparatus for supporting a member from a channel beam of a drop-tile ceiling comprising:

a decorative escutheon having a recess in the underside thereof and an opening therethrough communicating with said recess;

a resilient grasping element having first and second arms, the end of each of said arms bending at a joint toward the other to define opposed flanges, said resilient grasping element having an opening therein registrable with said opening in said escutheon, said arms being moveable from a first, open, position to a second, grasping, position as said resilient member is drawn into said recess;

said grasping element in said first, open, position defining a clearance between said flanges wider than the width dimension of a channel beam of a drop-tile ceiling, said grasping element in said second, grasping, position contacting said joints against the lateral edges of a channel beam of a drop-tile ceiling; and, a threaded nut mounted on said resilient grasping element to register with said opening therein, said nut adapted to receive a threaded element insertable through said registered openings in said escutheon and said resilient grasping element such that progressive threaded engagement of said nut with the insertable element draws said resilient grasping element against the bias of its resiliency into said recess to move said grasping element from said open to said grasping position.

11. Apparatus according to claim 10, wherein said recess in said decorative escutheon is substantially square in a plane perpendicular to an axis through said opening.

12. Apparatus according to claim 11, wherein said dimension of said square is at least 3/16 of an inch greater than the width dimension of a channel beam of a drop-tile ceiling.

* * * * *